United States Patent [19]

Werner

[11] 4,050,489

[45] Sept. 27, 1977

[54] METHOD FOR FABRICATING A LAMP BASE

[76] Inventor: Harvey Albert Werner, 6531 Kessler Ave., Woodland Hills, Calif. 91367

[21] Appl. No.: 741,884

[22] Filed: Nov. 15, 1976

Related U.S. Application Data

[62] Division of Ser. No. 695,965, June 14, 1976.

[51] Int. Cl.[2] ..... B27D 1/10

[52] U.S. Cl. ..... 144/315 R; 144/309 A; 144/323; 156/250; 156/264

[58] Field of Search ..... 156/256, 264, 250; 144/309 R, 309 A, 314 R, 314 B, 315 R, 316, 326 R, 134 R, 321, 323

[56] References Cited

U.S. PATENT DOCUMENTS

| | | | |
|---|---|---|---|
| 1,994,204 | 3/1935 | Walls | 144/309 A |
| 2,382,208 | 8/1945 | Corbin | 156/264 X |

*Primary Examiner*—Othell M. Simpson
*Assistant Examiner*—W. D. Bray
*Attorney, Agent, or Firm*—Craig O. Malin

[57] ABSTRACT

A method of fabricating a lamp, wherein the lamp base is made by providing a polyhedral block of wood and cutting the vertical plane faces of the block to form vertically curved sides while still maintaining the straight shape of the faces in the horizontal direction.

2 Claims, 2 Drawing Figures

METHOD FOR FABRICATING A LAMP BASE

This application is a division of application Serial No. 695,324 filed June 14, 1976.

BACKGROUND OF THE INVENTION

This invention relates to the field of furniture, particularly to lamps.

A wide variety of lamps have been created in the prior art to meet the many demands of interior decorators. These prior art lamps generally have ceramic or metal bases and fibre shades. Occasionally, expensive hand carved wood is used for the base of the lamp. However, most often, the wooden base is turned on a lathe which always results in a base having a circular section. Thus, these wooden lamps tend to have a monotonous similarity in appearance.

Many people like the beauty and natural look of wood, and these people are continuously looking for distinctive wooden furniture. The prior art lathe-turned wooden lamp bases with their cloth shades severely limit the choice available in this highly selective market.

Therefore, there exists a continuing need for distinctive lamps of obviously high quality and novelty.

SUMMARY OF THE INVENTION

It is an objective of the invention to provide a method of making a distinctive lamp of obvious high quality.

It is a further object of the invention to provide a method of making a lamp base of predominantly wooden construction which is unique in shape from prior art wooden lamp bases.

According to the invention, the base is made by providing a polyhedral block of wood and cutting the vertical plane faces of the block to form vertically curved sides while still maintaining the straight shape of the faces in the horizontal direction.

BRIEF DESCRIPTION OF THE DRAWINGS

The invention will now be described in detail with reference to the accompanying drawings representing preferred embodiment of the lamp according to the present invention. In the drawings.

DESCRIPTION OF THE PREFERRED EMBODIMENTS

Figure 1:
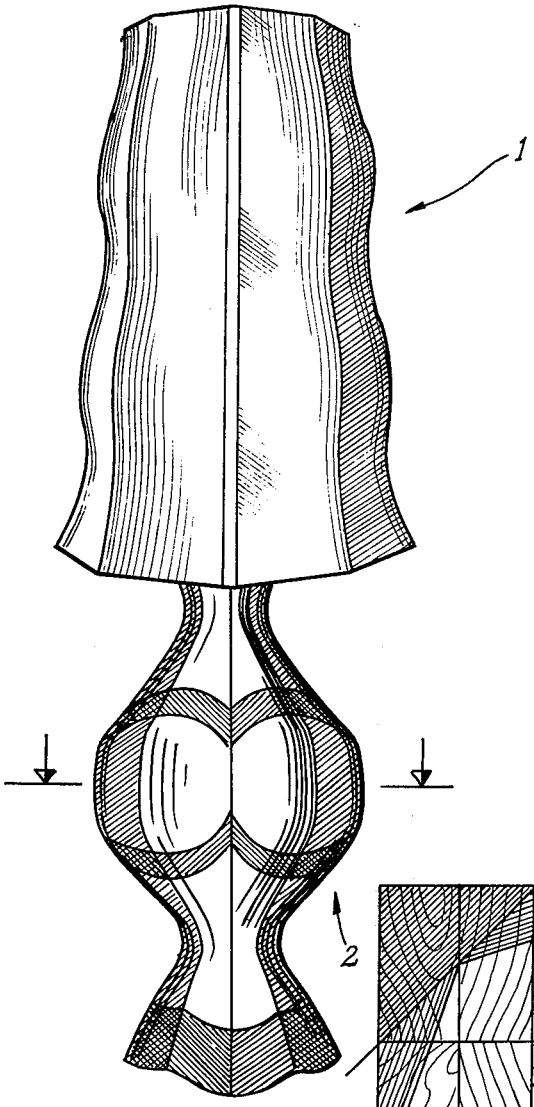
FIG. 1 is a perspective view of the lamp.

FIG. 1 is a perspective view of the lamp assembly showing the shade 1 and base 2. In the vertical direction, the faces of both the base and shade are gently curving. However, in the horizontal direction the faces are straight, as best shown by the dotted line 4 in FIG. 2. This type of configuration cannot be duplicated on a lathe because rotation of the part in the lathe results in a circular cross-section.

Figure 2:
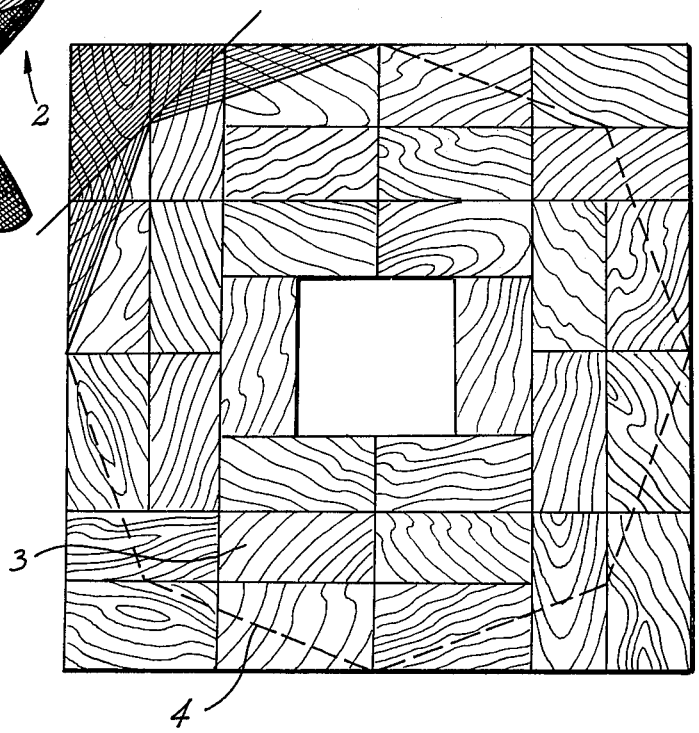
FIG. 2 is a cross-section of the lamp base at 2—2 of FIG. 1 showing how the cross-section is formed from a square block of wood.

FIG. 2 shows a preferred method of fabricating base 2. Boards 3 approximately 1½ inches thick and as long as the height of the base are bonded together to form a square cross-section. As shown, boards can be omitted from the center to provide a center hole for the electrical wiring of the lamp. Each corner of the square is cut off for a distance of ¼ of each side as shown by the lightly shaded area. Two further cuts are made as shown by the darkly shaded areas to form an octagonal cross-section extending the entire length of the block.

The size of the octagonal cross-section is then varied along the height of the block by cutting into the faces to create a curved surface in the vertical directions as shown in FIG. 1. However, the octagonal cross-section with straight sides is maintained throughout the entire length of the base. Further, the intersections of the octagonal faces are maintained in a vertical plane. The result is a mixture of curved and straight lines which provice a pleasing appearance surprisingly different from the usual lathe-turned wood construction.

Further adding to the pleasing, natural wood appearance is the curved end grain design formed on the face of the base as a result of the mosaic construction, as shown in FIG. 1.

From the foregoing, it can be realized that this invention can assume various embodiments. Thus, it is to be understood that the invention is not limited to the specific embodiments described herein, but is to be limited only by the appended claims.

What is claimed is:

1. A method for making a lamp base comprising the steps of:

providing a polyhedronal block of wood having a cross-section which is symmetrical about a longitudinal axis and having plane faces whose vertical intersections are parallel to said longitudinal axis; and cutting said plane faces to vary the cross-sectional area of said block along its height and to form sides on said block which are curved in the vertical direction and straight in the horizontal direction, said sides intersecting each other to form curved edges which lie in a vertical plane.

2. The method for making a lamp base as claimed in claim 1, whereby said providing step comprises:

joining together rectangular boards to form a rectangular parallelpiped block having a square cross-section; and removing wood from the corners of said square cross-section to change said square cross-section to a regular octagonal cross-section.

* * * * *